United States Patent [19]

Tawzer

[11] Patent Number: 4,980,997

[45] Date of Patent: Jan. 1, 1991

[54] ROOFING SYSTEM WITH INTEGRAL GUTTER

[75] Inventor: Charles E. Tawzer, Portland, Oreg.

[73] Assignee: A-1 All Weather Roofing, Inc., Portland, Oreg.

[21] Appl. No.: 433,749

[22] Filed: Nov. 9, 1989

[51] Int. Cl.[5] ..... E04D 13/00

[52] U.S. Cl. ..... 52/15; 52/16; 52/58; 52/95; 52/97

[58] Field of Search ..... 52/11, 16, 58, 94, 95, 52/97, 15

[56] References Cited

U.S. PATENT DOCUMENTS

| | | | |
|---|---|---|---|
| 2,801,601 | 8/1957 | Riedel | 52/11 |
| 4,598,507 | 7/1986 | Hickman | 52/94 |
| 4,800,689 | 1/1989 | Lane | 52/94 X |

FOREIGN PATENT DOCUMENTS

| | | | |
|---|---|---|---|
| 1509117 | 7/1969 | Fed. Rep. of Germany | 52/11 |
| 2175027 | 11/1986 | United Kingdom | 52/11 |

*Primary Examiner*—David A. Scherbel
*Assistant Examiner*—Lan Mai
*Attorney, Agent, or Firm*—Chernoff, Vilhauer, McClung & Stenzel

[57] ABSTRACT

A roofing system for a sloped roof having a base with a generally horizontal top surface and a generally vertical edge has an internal gutter in its lower margin. The system includes a first flashing, that is attached to the base, having a lip which projects from the top surface of the base. The base is covered with sheets of flexible, thermally weldable roofing material with the top margin of each sheet being attached to the base and the bottom margin overlapping and welded to the adjoining sheet. The lower margin of the lowest sheet overlies the lip of the first flashing to form the gutter. A second flashing, which conformingly overlies the first flashing, is attached to the base over the sheet to clamp the margin of the sheet against the edge of the base. The margin of the lowermost sheet is pulled progressively tauter over the lip of the first flashing at the sides of the roof than at the downspout to make the gutter slope downwardly towards the downspout. A tack strip of the roofing material is attached to the roof base adjacent to the edge at an angle such that it is progressively further from the edge extending away from the downspout. The lowermost sheet is thermally welded to the tack strip before it is pulled over the lip of the first flashing and the second flashing is installed, which causes it to automatically be biased to form the slope in the gutter.

4 Claims, 2 Drawing Sheets

ROOFING SYSTEM WITH INTEGRAL GUTTER

BACKGROUND AND SUMMARY OF THE INVENTION

This invention relates to a roof having a gutter formed internally therein by the roofing material.

Mobile homes and similar structures cannot easily utilize standard home type external gutters. First, mobile homes typically do not have eaves but instead the roof ends at the side of the structure. Accordingly, the roof does not partially overhang the gutter and water from the roof tends to run between the gutter and the structure. This requires application of a sealant between the gutter and the structure which makes installation more costly and requires constant resealing to prevent leaking. In addition, in order to provide the slope necessary for the gutter to drain properly the majority of the gutter must be offset vertically from the roof which heightens the sealing problem. Finally, there is no structure on a mobile home from which external gutters can be hung that will support the weight of the gutter when it is full of water. Thus, if the gutter or downspout becomes plugged and water backs up into the gutter, it will pull free from the structure.

The roofing system of the present invention includes an internal gutter which is part of the roof itself and thus eliminates the necessity of installing an external gutter on this type of structure. A first flashing, which is attached to the edge of the roof base, has a lip that protrudes outwardly from the top surface of the base. The upper margin of a sheet of flexible, heat weldable roofing material is attached to the base, with the lower margin extending over the lip and down across the edge of the base. A second flashing, which conformingly overlies the first flashing, is then attached to the edge of the base, to clamp the lower margin of the sheet of roofing material between the first and second flashings. The margin of the sheet of roofing material extending upwardly over the lip acts as a gutter and prevents water from flowing off of the edge of the roof. In order to make the gutter slope from the sides of the roof toward the downspout, the sheet of material is pulled progressively more tautly over the lip of the first flashing extending away from the downspout.

The remainder of the base is then covered with additional sheets of roofing material with the bottom margin of each sheet overlapping the top margin of the downwardly adjacent sheet and the top margin of each sheet being attached to the base. The overlapping sheets are thermally welded together to form a watertight seal between them.

Accordingly, it is a principal object of the subject invention to provide a roofing system having an internal gutter formed integrally in its edge.

It is a further object of the subject invention to provide such a roofing system in which the gutter slopes from the sides of the roof toward the downspout.

It is a still further object of the subject invention to provide such a roofing system which is inexpensive and is easily installed.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
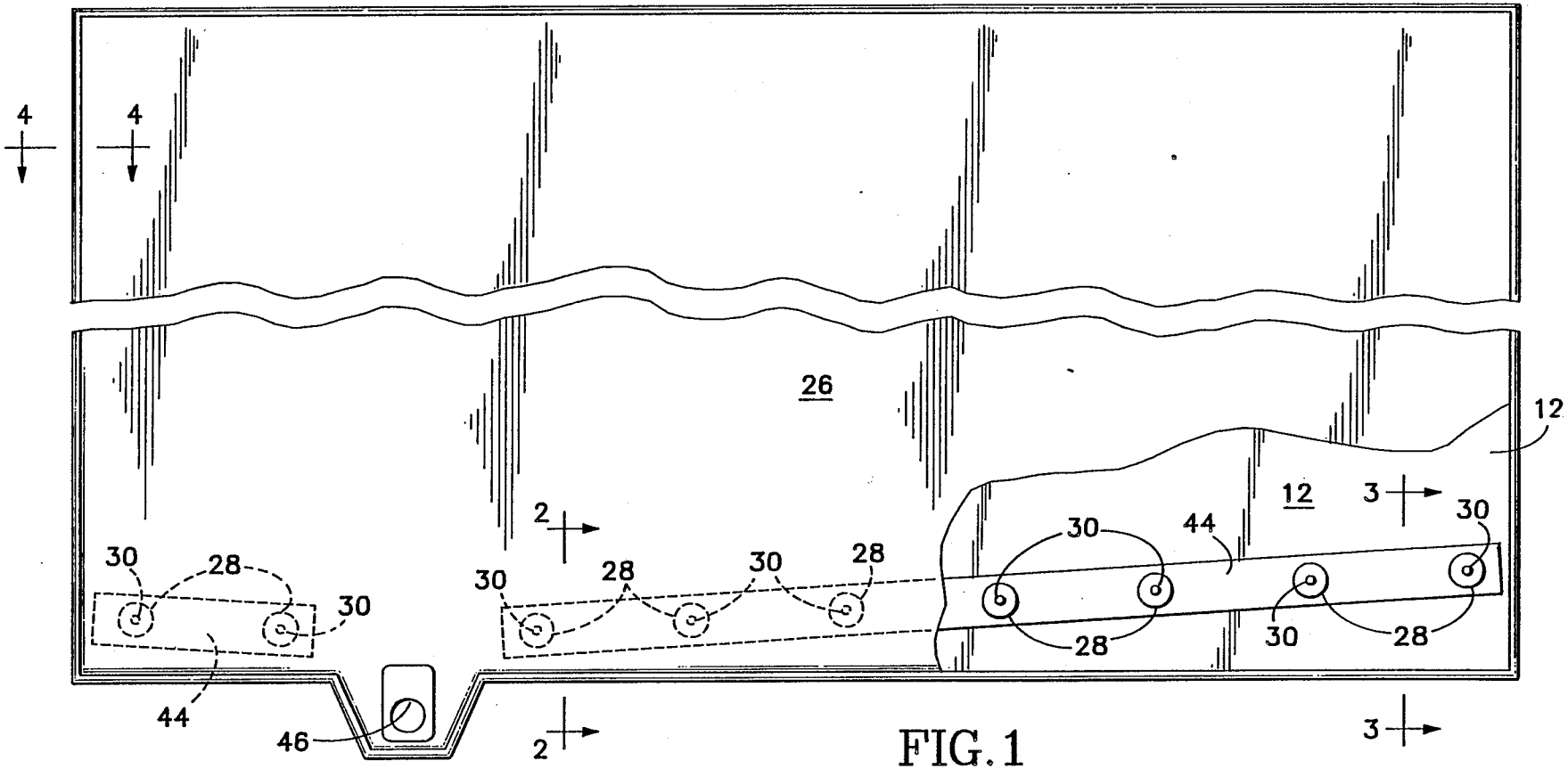
FIG. 1 is a plan view of a roof, foreshortened and partially broken away to show hidden detail, of a roof embodying the subject invention.

Referring to the drawings, the roofing system of the subject invention is installed on a base 10, which for purposes of illustration is shown as being a solid wood panel. The system is used with many other types of roof construction as well, so long as the roof base has a relatively smooth top surface 12 and slopes towards an edge 14 which is substantially perpendicular with the top surface and abuts the top surface at its lowermost point. The system is particularly well suited for mobile home roofs, which are not capable of satisfactorily carrying an external gutter.

The system includes an elongate first flashing 16 which is attached to the base 10 along the edge 14. The first flashing preferably is formed from a thin sheet of rust-resistant metal, although it could be plastic as long as it is sufficiently rigid without being overly thick. The first flashing should be as long as can easily be handled without buckling in order to minimize the number of joints. The first flashing has a generally vertical leg 18 which overlies the edge 14 and is attached to the base 10 by means such as screws 20. Extending upwardly from the vertical leg 18 is a lip 22 which protrudes above the top surface 12. The lip 22 doubles back down to the top surface where it joins with a horizontal leg 24 that overlies the top surface. The horizontal leg 24 also is attached to the base by means such as screws 20. If desired a bump 25 can be formed in the vertical leg 18 in order to increase the rigidity of the first flashing.

The roofing material is a thin, flexible thermoplastic material which is hot air weldable. Such material is commercially available in rolls for this purpose. The material is placed on the base in overlapping sheets 26 which extend across the roof perpendicular to the direction it slopes. The upper margin of each sheet is affixed to the base by means of plates 28 and screws 30 which are covered by the lower margin 32 of the upwardly adjacent sheet, FIG. 4. The lower margin 32 of the upper sheet is then thermally welded to the lower sheet to form a seal between them. The lower margin 34 of the lowermost sheet is draped over the lip 22 and extends downwardly over the vertical leg 18 of the first flashing 16.

A second flashing 36, which overlies the first flashing 16 and the lower margin 34 of the sheet of roofing material, is also attached to the base 10 by means of screws 20. The lower margin 32 of the sheet of roofing material then is clamped between the first and second flashings. The second flashing includes a vertical leg 38 which overlies the entire vertical leg 18 and lip 22 of the first flashing 16. Located at the lower extremity of the vertical leg 38 is an inwardly turned tail 40 which covers the lower edge of the first flashing and provides a finished appearance. Located at the upper extremity of the vertical leg 38 is a bent-back cap 42 which fits over the top of the lip 22 and prevents relative movement between the first and second flashings. In addition, in the embodiment illustrated the vertical leg 38 of the second flashing contains a bump 43 which fits over the bump 25 in the first flashing and makes the second flashing more rigid.

Figure 2:
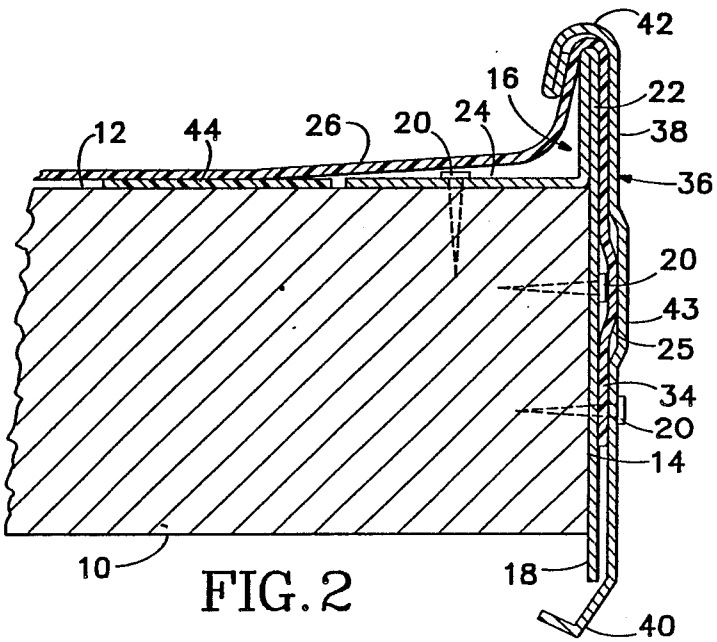
FIG. 2 is a sectional view, at an enlarged scale, taken along the line 2—2 on FIG. 1.
Figure 3:
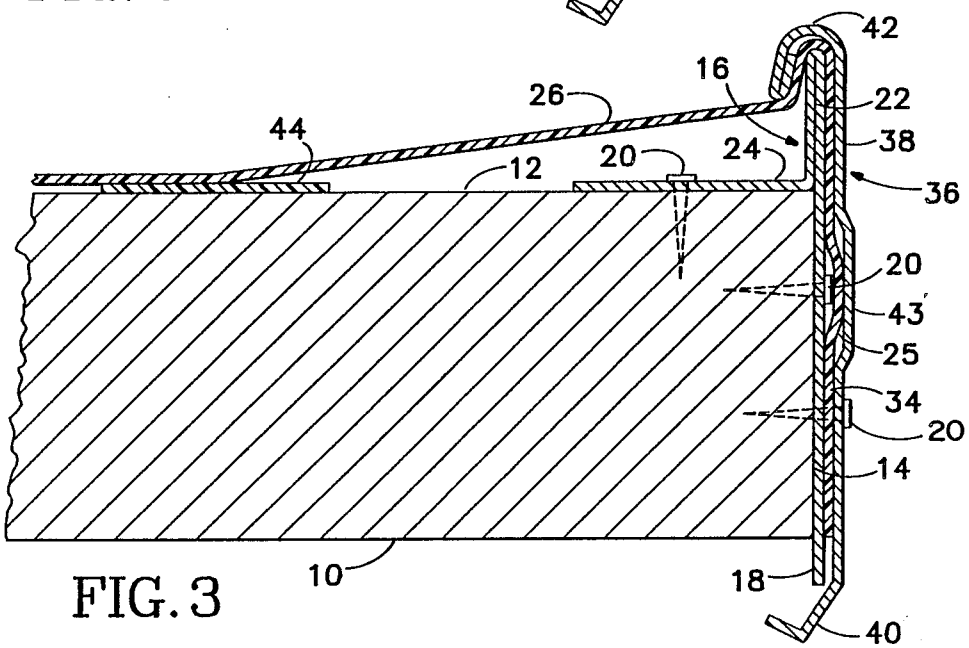
FIG. 3 is a sectional view, at an enlarged scale, taken along the line 3—3 on FIG. 1.

Extending the bottom-most sheet of roofing material 26 over the lip 22, coupled with the slope of the base 10, creates in effect an internal gutter at the edge of the roof. In order to make the gutter slope from the sides of the roof towards the downspout 46, the sheet of roofing material is pulled more tautly over the lip 22 at the sides of the roof, FIG. 3, and is pulled progressively less taut extending toward the downspout, FIG. 2. Since the upper edge of the sheet of roofing material is aligned parallel with the edge of the roof, this can be accomplished by placing the lower edge of the sheet as low as possible on the first flashing 16 at the sides of the roof and placing it progressively higher on the first flashing as it approaches the downspout.

To further simplify positioning the sheet of roofing material 26 over the lip 22 in a manner such that the gutter continuously slopes towards the downspout 46, a thin tack strip 44, of the same hot air weldable roofing material, is attached to the base proximate the edge 14. The tack strip 44 is positioned at an angle relative to the edge and is closest to the edge proximate the downspout. The tack strip is attached to the base with screws 30 and plates 28 in the manner used to attach the roofing material to the base. After the upper edge 32 of the lowermost sheet of roofing material has been attached to the base, the remainder of the sheet is laid flat on the base and the sheet is thermally tack welded to the tack strip 44 at several points along the tack strip. The material then only needs to be pulled tautly over the lip 22 and the second flashing 36 installed, and the resulting gutter will be sloped with little, if any, necessity of hand-forming the gutter to ensure that this is the case.

In the embodiment illustrated, the edge of the roof projects outwardly in a trapezoidal pad 48 which permits the downspout 46 to be located outside of the normal edge of the roof. This configuration is necessary for most mobile home roofs where there is little or no overhang.

Figure 4:
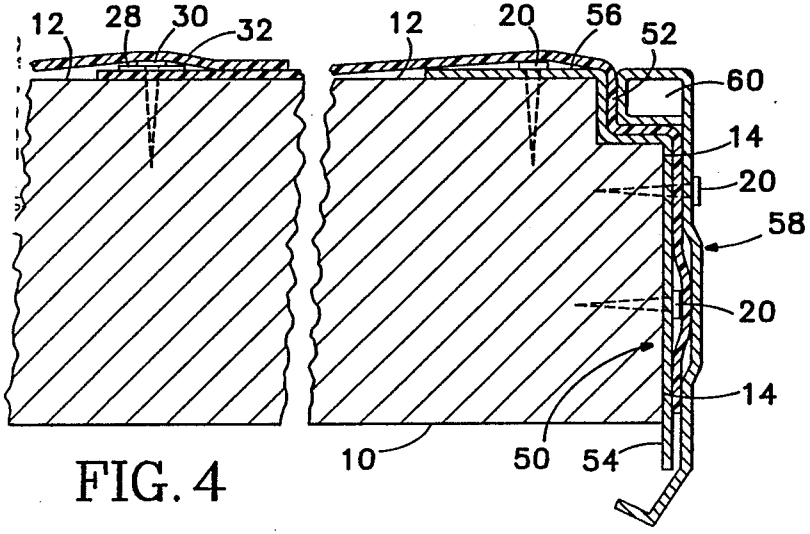
FIG. 4 is a sectional view, at an enlarged scale, taken along the line 4—4 on FIG. 1.

Referring to FIG. 4, the ends of the sheets of roofing material are sealed to the base by using a modified first flashing 50 which does not have a lip. With this embodiment a cavity 52 is located between the vertical leg 54, which overlies the edge 14, and the horizontal leg 46, which overlies the top surface 12. In this embodiment the top of the modified second flashing 58 includes a rectangular box 60 which fits into the cavity 52.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A roofing system with an integral gutter, comprising:

(a) a sloped roof base having a top surface and an edge which abuts the lowest portion of and is substantially perpendicular to said top surface;

(b) a first flashing which is attached to said base along said edge, said first flashing having a lip which is substantially coplanar with said edge and projects above said top surface;

(c) an elongate sheet of flexible roofing material, having one elongate margin affixed to said base and the opposed margin draped over said lip and extending over said edge so that a center portion of said sheet of roofing material is suspended above said top surface to form a gutter adjacent to said edge;

(d) a second flashing which overlies said first flashing;

(e) means for affixing said second flashing to said base with said opposed margin of said sheet of roofing material clamped between said first and second flashings;

(f) a downspout extending downwardly from said base proximate said edge, said downspout being fluidly connected to said sheet of roofing material; and (g) wherein said center portion is arcuate proximate said downspout and becomes relatively less arcuate extending away from said downspout along said edge, so that the gutter formed by said center portion slopes toward said downspout.

2. The roofing system of claim 1 wherein said first flashing comprises:

(a) a generally horizontal leg which overlies said roof base;

(b) a generally vertical leg which overlies said edge; and (c) said lip interconnects said horizontal and vertical legs.

3. The roofing system of claim 2 wherein said second flashing includes a bent-back cap at its upper extremity which fits over said lip.

4. The roofing system of claim 1 wherein said roofing material is a hot air weldable thermoplastic material including:

(a) a strip of said roofing material which is substantially narrower than said sheet of roofing material;

(b) said strip of roofing material being attached to said base beneath said sheet of roofing material along a line that is oriented at an angle with respect to said edge;

(c) wherein said line is progressively further from said edge extending along said edge away from said downspout; and (d) said sheet of roofing material is thermally welded to said strip of roofing material.

* * * * *